US009350113B2

(12) United States Patent
Garner et al.

(10) Patent No.: US 9,350,113 B2
(45) Date of Patent: May 24, 2016

(54) ELECTRICAL OUTLET RECEPTACLE ACCESS RELOCATION DEVICE

(71) Applicants: Michael Lynn Garner, Gray, TN (US); Daniel Jonathan Jones, Maryville, TN (US)

(72) Inventors: Michael Lynn Garner, Gray, TN (US); Daniel Jonathan Jones, Maryville, TN (US)

( * ) Notice: Subject to any disclaimer, the term of this patent is extended or adjusted under 35 U.S.C. 154(b) by 201 days.

(21) Appl. No.: 13/974,013

(22) Filed: Aug. 22, 2013

(65) Prior Publication Data

US 2015/0056849 A1 Feb. 26, 2015

(51) Int. Cl.

*H01R 11/00* (2006.01)
*H01R 13/58* (2006.01)
*H01R 25/00* (2006.01)

(52) U.S. Cl.

CPC ..... *H01R 13/5841* (2013.01); *H01R 25/003* (2013.01); *H01R 25/00* (2013.01)

(58) Field of Classification Search

USPC ..... 439/32, 502, 536
See application file for complete search history.

(56) References Cited

U.S. PATENT DOCUMENTS 4,103,101 A * 7/1978 Maier ..... H05K 5/04 174/660
4,245,873 A * 1/1981 Markowitz ..... H01R 25/003 439/32
5,562,488 A * 10/1996 Neiser ..... H01R 13/514 439/373
6,004,138 A * 12/1999 Harbertson ..... H01R 25/003 439/21
6,077,086 A * 6/2000 LaRoche ..... H01R 25/006 439/173
6,248,952 B1 * 6/2001 Reeves ..... H02G 3/06 16/2.1
D461,774 S * 8/2002 Genicevitch ..... D13/137.2
D472,520 S * 4/2003 Genicevitch ..... D13/137.2
D489,328 S * 5/2004 Oswalt ..... D13/137.1
7,220,128 B1 * 5/2007 Hicks ..... H01R 25/00 439/32
8,727,804 B2 * 5/2014 McNeely ..... A61B 5/0006 439/502
2005/0221662 A1 * 10/2005 Lai ..... H01R 13/60 439/502

* cited by examiner

*Primary Examiner* — Tho D Ta

(57) ABSTRACT

A self-contained, readily adaptable electrical receptacle outlet relocation device comprising; an adaptor housing having a plurality of conductors connected in common with building mains extending outward at rear of housing, and adaptable to an existing duplex receptacle receiving and transferring mains power only therefrom, providing no electrical plug in access, and wherein mains transferring through conductors in common by wiring therein adaptor and through flexible electrical conduit attached and secured within adaptor by a conduit connector having a concave groove at one housing end that provides method of attachment to adaptor, and conduit to receiver housing, connected thereto conduit and wire of adaptor having same conduit connector groove as attachment method and wire connected in common therein receiver to at least one corresponding duplex receptacle attached therein as the relocated receptacle option and provides multiple adjustment options to receiver, horizontally left or right, vertically up or down, and any combination thereof allowing novice individuals to temporarily or permanently relocate an existing hidden or difficult to access electrical receptacle, by the alternative receptacle of device, to an adjacent location for easier and safer receptacle access.

8 Claims, 4 Drawing Sheets

ELECTRICAL OUTLET RECEPTACLE ACCESS RELOCATION DEVICE

CROSS-REFERENCED TO RELATED APPLICATIONS

The present application claims the benefit and priority of U.S. Provisional Application No. 61/742,963, Filed Aug. 23, 2012 Titled, Electrical Outlet Receptacle Relocation System/Device, of which the entire disclosure of is incorporated by reference herein.

STATEMENT REGARDING FEDERALLY SPONSORED RESEARCH OR DEVELOPMENT

Not applicable.

BACKGROUND OF INVENTION

1. Technical Field of Invention

Electrical power outlet receptacles routinely become partially obscured or blocked from access due to placement of furniture in homes and office furnishings or items and causing difficulties or at best is very annoying and many times can be dangerous when attempting to move said furniture or office items when attempting to access an obscured outlet receptacle to plug in an electrically powered device. The inventors are aware of inadequacies of current methods utilized such as extension cords, power strips, complicated electrical raceways or track systems and patented systems or devices not proven or not certified as to their safety or functionality due to some having questionable or impractical designs or methods.

The invention of this application discloses an adaptable electrical device comprised of; two different housings connected in common by electrical wiring within flexible electrical conduit attached to housings by a conduit connector with a concave groove on housing end and channeling wiring from electrical conductors within adaptor housing to at least one electrical duplex receptacle within the receiver housing therefore is a novel, self-contained, readily adaptable device allowing individuals to, temporarily or permanently, relocate existing electrical outlet receptacles, from difficult to access locations to adjacent locations, horizontally left or right, and or vertically above or below, or any combination thereof from existing outlet location by a corresponding alternative receptacle within device to a better location for easier and safer receptacle access.

2. Disclosure of Prior Art

Prior art listed is similar as to solutions to the problem disclosed above and as to what is claimed for the device of this application however all prior art forms utilize untested methods and devices and some not adhering to national or international electrical standards. Morin, U.S. Pat. No. 5,700,150, Dec. 23, 1997, Electrical Outlet Type Extension Cord Real with Auxiliary Outlet, shows an electrical device that connects to wall outlet receptacles providing a direct plug in ability thereat and comprising a reel method having a length of ungrounded common extension connected to a duplex three prong receptacle type. Morin has some claims similar to the device of this application but would be clearly would be clearly superior by anyone skilled in the art. Additionally his specifications clearly states the devices receptacle extension method is temporary function and when until no longer needed, wind it back into said housing and stored there till use is required again. Morin clearly utilizes a simple extension cord with no ground wire connected to a three prong type receptacle having no method of ground which could make individuals think it is a grounded circuit and is clearly a critical safety issue and not the case of the device of this application which adheres to strict electrical industry standards and regulations as either a temporary or a permanent device.

Elmouchi, U.S. Pat. No. 5,788,517, Aug. 4, 1998, Cordless Extension System, shows a system of attachable housings and connectable components, molded straight and corner track sections, and various covers for providing safety and decor for exposed track sections having embedded wire within and on said track that when assembled provides individuals the ability to add electrical outlet boxes, receptacles, switches, light fixtures, etc., to change or add electrical accesses or outlet locations along walls, partitions. The array of components disclosed would show individuals, experienced in the field of endeavor, said system is not a device, not self-enclosed, and not readily adaptable, as the device of this application clearly provides.

Hicks, U.S. Pat. No. 7,220,128, May 22, 2007, Titled, Extendable Power Source Device, and Harbertson, U.S. Pat. No. 6,004,138, Dec. 23, 1997, Titled, Electric Outlet Extender, showing nearly identical devices with various components having additional sliding and telescoping components within another and wire strips embedded thereon inwardly with electrical contacts that allow said components to slide along while still maintaining solid continuity. The inventors of this application question the unsubstantiated and probably untested connection method of their devices and ability to gain certification or approval for such contacts methods due to potential loosening, creating heat, and thereby presenting a real fire hazard potential as anyone skilled in electrical methods and device standards would question before such designs could warrant approval for marketing to the public. Another disadvantage of Hicks and Harbertson's devices relates to their aesthetic qualities and in reality, would not be pleasing or very acceptable to individuals when attaching objects to the walls in their homes or any other building types. The device of this application provides a corresponding common single or duplex electrical receptacle as an alternative to an existing hidden or difficult to access receptacles and in a standard vertical orientation like a common replacement receptacle that individuals could not differentiate from original and the device of this application utilizes commonly accepted electrical components for reliability and assurance for safety.

SUMMARY OF INVENTION

The device presented in this application is a fully assembled and readily adaptable device comprising; an adaptor housing, having electrical conductors and grounded circuit adaptable to common electrical duplex receptacles, after removing the receptacle cover, and securing thereto by adaptor, receivable of mains power and transferring through said conductors, wired in common therein adaptor, and wiring channeled therefrom by flexible conduit connected to housing by a conduit connector, each having a concave groove, of a specific diameter, at one end, as the attachment method to the adaptor housing, which allows conduit to traverse or swing up to 180 degrees, left or right, of said adaptor housing when attached to existing receptacle location, and same conduit connected to receiver housing, by same type conduit connector with concave groove attachment method, allowing same 180 degree horizontal traversing, left or right, and further, each conduit connector on one end having a concave groove, when assembled to device housings at manufacture, the connection also allows receiver housing 180 degree rotational adjustments, left or right, wherein wiring of receiver housing connected in common to a duplex receptacle attached within receiver, and having an common receptacle cover, provides an alternative receptacle for relocating from a difficult to access receptacle by physically relocating receiver housing, left or right, of the adaptor housing, and by nature of flexible conduit, allows horizontal and vertical adjustment options above or below adaptor, and any in between adjustments, thereby allowing novice individuals, the ability to relocate duplex receptacles, in difficult to see and/or difficult access locations, to an alternative temporary or permanent locations, for easier and safer receptacle access.

For illustration purposes drawings for the device of this application depicts an adaptor housing, with preformed electrical conductors with ground pins, common to grounded duplex receptacles and conductors transfers mains power only from adaptor, having no power cord plug in access, and adaptor is connected to approved wiring channeled within approved flexible conduit that is attached to adaptor by a conduit connector having a concave groove attachment point within to adaptor and connected by same wiring, conduit connectors, and flexible conduit to a receiver housing that provides the corresponding receptacle or receptacles of device presented. The device is not limited in scope to duplex receptacles only, in that device can adapt many types of electrical wall receptacles within receiver housing, up to and including 50 amp 250 volt receptacles, when utilizing corresponding conductors within adaptor housing and corresponding conduit connectors, conduit, and appropriate electrical wire size and rating.

DETAILED DESCRIPTION OF DRAWINGS

Figure 1:
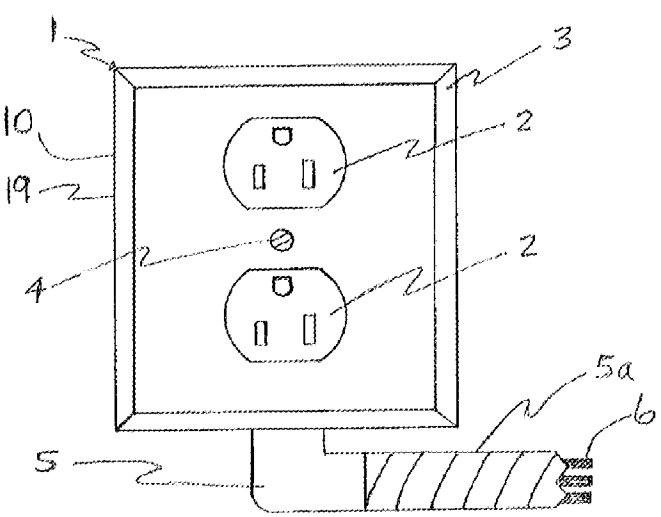
FIG. 1 depicts a frontal plan view of a receiver housing.
Figure 5:
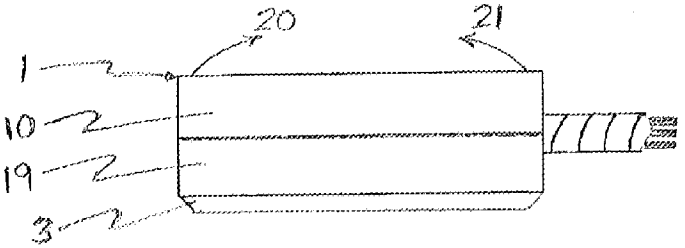
FIG. 5 depicts a top plan view of a receiver housing.
Figure 7:
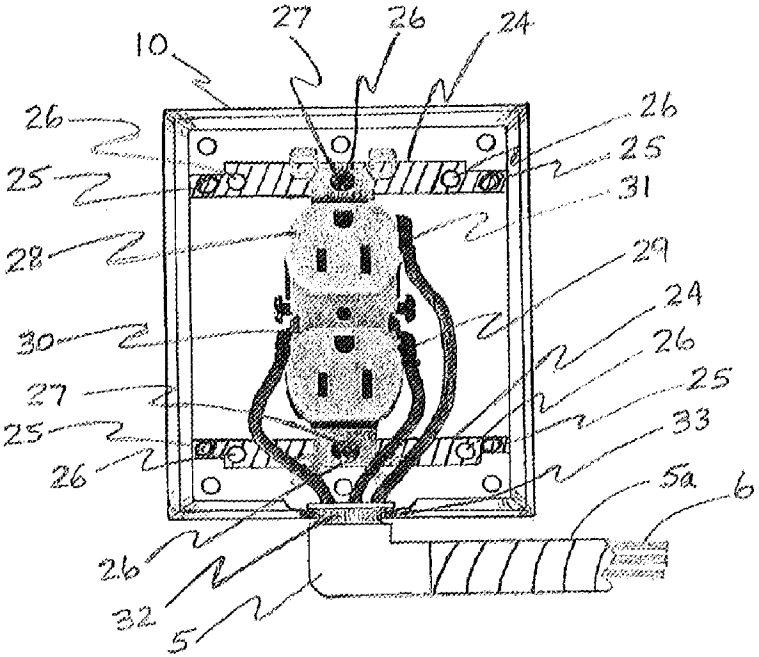
FIG. 7 depicts a front perspective view of rear component of receiver housing with an adapted receptacle therein and a conduit connector having an attachment groove.

FIG. 1 is a frontal view of a receiver housing 1 comprising of; components 10 and 19, depicted also in FIG. 5, and having a common three prong duplex receptacle 2 attached and further depicted in FIG. 7 and showing a standard duplex receptacle cover 3 with cover retainer screw 4, and 1 attached to a 90 degree conduit connector 5, connected to flexible conduit 5(*a*), of a predetermined length, channeling at least a 14 AWG wiring 6 hardwired in common to receptacle 2.

Figure 2:
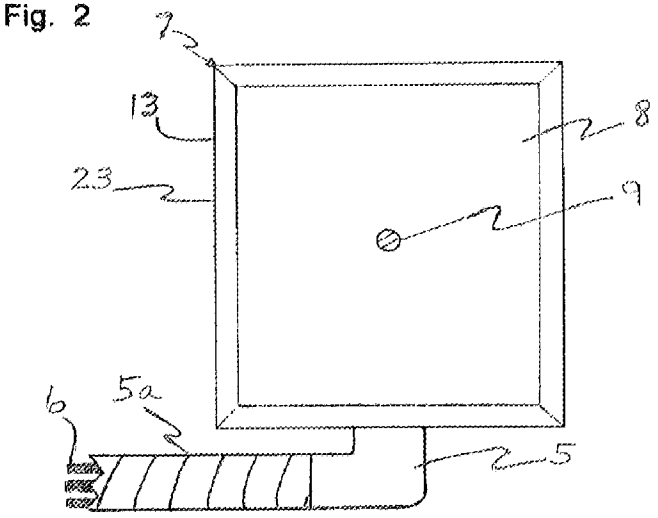
FIG. 2 depicts a frontal plan view of a adaptor housing.
Figure 6:
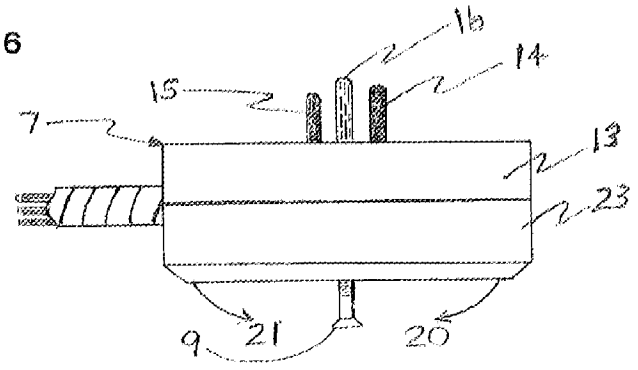
FIG. 6 depicts a top plan view of a adaptor housing.

FIG. 2 is a frontal view of an adaptor housing 7 comprising rear component 13 and front component 23 also in FIG. 6, showing 23 having a plain frontal surface with an electrical receptacle attachment screw 9 and 7 connectable to a 90 degree conduit connector 5 connected to same conduit 5(*a*) channeling same wire 6 therefrom from receiver and hardwired in common therein 13 to preformed metal strip conductors in FIG.'S 4, 6, and 8.

Figure 3:
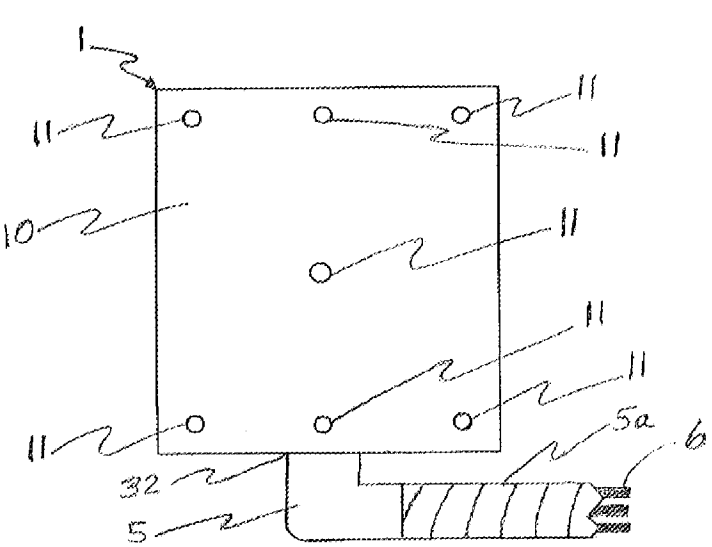
FIG. 3 depicts a 180 degree rotational rear plan view of a receiver housing.

FIG. 3 is a 180 degree rotated rear plan view of receiver 1 of FIG. 1, depicting a plain rear component 10, incorporating attachment holes 11 as wall or partition mounting hardware options, included with device, and component 1 connectable thereto a 90 degree conduit connector 5 having a concave groove attachment point 32 depicted in FIG.'S 7, 9, and 10 and showing same said conduit and wiring.

Figure 4:
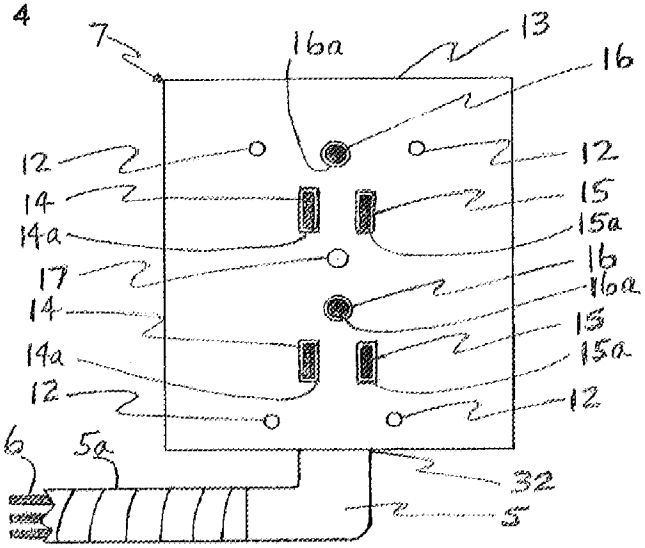
FIG. 4 depicts a 180 degree rotational rear plan view of adaptor housing.
Figure 8:
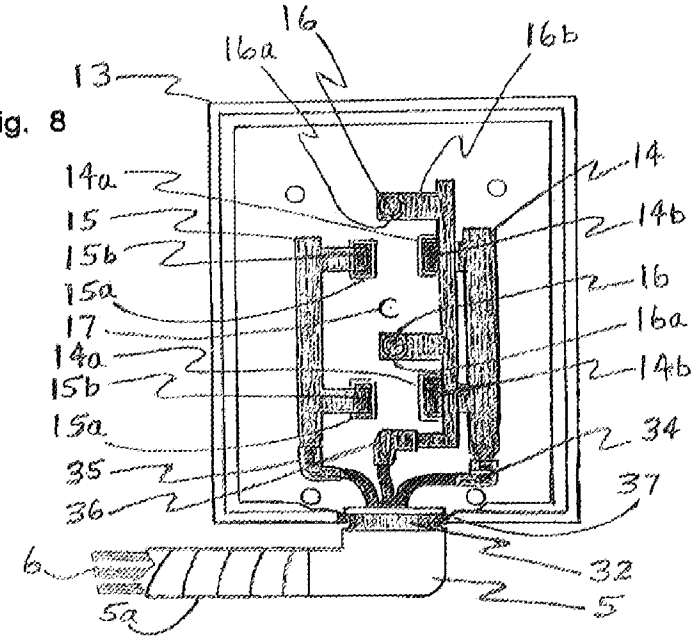
FIG. 8 depicts a front perspective view of rear component of adaptor housing with metal conductors therein and a conduit connector having an attachment groove.
Figure 10:
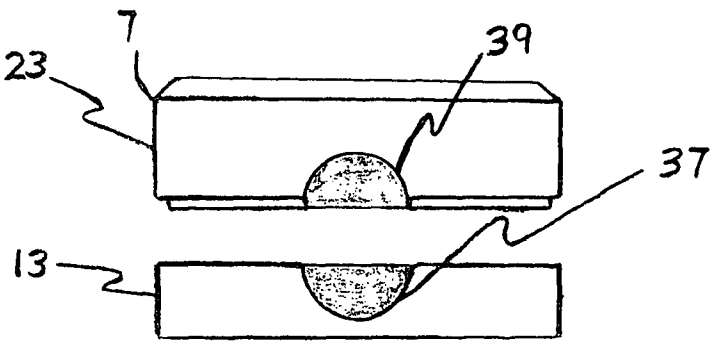
FIG. 10 depicts a bottom exploded view of front and rear components of the adaptor housing, each having a centered inward facing half circle conduit opening.
Figure 9:
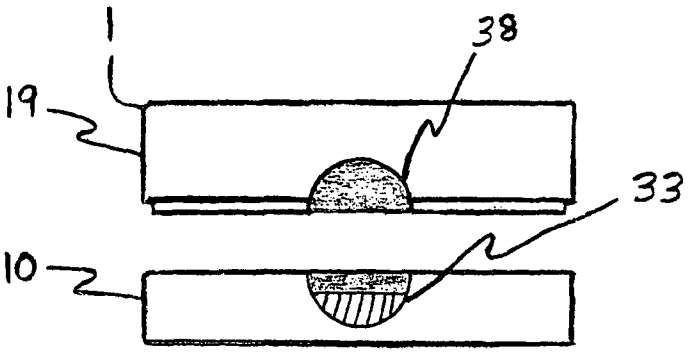
FIG. 9 depicts a bottom exploded view of front and rear components of the receiver housing, each having a centered inward facing half circle conduit opening.

FIG. 4 is a 180 degree rotated rear plan view of adaptor housing 7 of FIG. 2; depicting rear housing component 13 incorporating housing component attachment holes 12 for assembling component 13 to component 23 shown in FIG. 6, which incorporates internally molded hardware guides and housing supports, not shown, thereby comprising housing 7 and further depicting male blade conductors 14 and 15 and ground pins 16 vertically aligned, and extending rearward of 13 through slots 14*a*, 15*a*, and holes 16*a* and traversing inward therein 7, also depicted in FIG. 8, with conductors hardwired in common to mains, and incorporating hardware attachment hole 17 at center of 8 and through 7 as depicted in FIG. 6, for securing 7 to existing duplex receptacles after removing receptacles cover, not shown, and 7 connectable to 5 and having a concave groove attachment point 32 depicted in FIGS. 8 9, and 10 and showing same said conduit and wiring.

FIG. 5 is a top plan view depicting receiver housing 1 comprising of assembled rear component 10, front component 19, and receptacle cover 3, and depicting housing 1 having up to 180 degree axial rotational adjustment options 20, left to right, and 21, right to left, allowable by attachment point 32 shown in FIG.'S 7 and 9.

FIG. 6 is a top plan view depicting adaptor housing 7 comprising; rear component 13, front component 23, assembled at manufacture and having preformed metal blade conductors, 14 common to neutral, 15 common to hot, and pins 16 common to ground, vertically aligned extending rearward through slots 13, not shown, and having a receptacle attachment screw 9 centered frontally, and through 23 and 13 for securing 7 to existing duplex outlet receptacles, not shown, and adaptor 7 can rotate up to 180 degree of axis rotation adjustments 20, right to left, and 21, left to right, that is allowed by attachment point 32 shown in FIG.'S 8 and 10.

FIG. 7 depicts a front perspective view of rear component 10 with front component 19, and receptacle cover 3 removed, wherein 10 comprising molded supports 24 having hardware attachment points 25 for assembling structures 19 to 10 at manufacture and further showing four of six hardware attachment points 26 for securing at least one and up to two common electrical receptacles, two points 26 are utilized for receptacle 28, and all points 26 correspond with NEMA, National Electrical Manufacturers Association, guidelines for electrical receptacle hardware attachment patterns. FIG. 7 further depicts a common three prong duplex receptacle 28 adapted thereon supports 24 securely attaching 28 by screws 27, and further receptacle 28 is hardwired in common to wire 6 to, neutral 29, hot 30, and ground 31. FIG. 7 further still depicts conduit 5*a* connected into 90 degree conduit connector 5 having a concave groove 32, of less diameter than component 10 attachment opening 33, also depicted in FIG. 9, thereby connector 5 inserted into opening 33, when components 10 and 19 of FIG. 6 are assembled at manufacture, allows receiver housing 1 both horizontal traversing left or right and axial rotation adjustments up to 180 degrees, left to right or right to left, as stated in FIG. 5, as needed when relocating access point of receptacle 28 of housing 1.

FIG. 8 depicts a front perspective view of component 13 with front component 23 removed and comprising: three preformed metal strip conductors; strip 14 formed of two vertical aligned blades extending rearward of component 13 of FIG. 6, traversing inwardly through corresponding slots 14*a* forming to 90 degree bends 14*b* of strip 14, and further traversing to spade style end, not shown, and wired to high temperature steel female spade connector 34 in common to mains neutral, and strip 15 formed of two vertical aligned blades extending rearward of 13 of FIG. 6, traversing back inwardly through corresponding slots 15*a* and forming to 90 degree bends 15*b* and to strip 15 and further traversing to a spade style end, not shown, and wired to steel female type spade connector 35 in common with mains hot, and two ground pins 16, vertically aligned, centered between 14 and 15, and extending rearward of 13, of FIG. 6, traversing inward through holes 16*a* to strip 16*b*, where having been connected and welded 16 traversing to a spade style end, not shown, and wired in common with ground by said high temperature steel female connector 36. FIG. 8 further still depicts conduit 5*a* connected into 90 degree conduit connector 5 having a concave groove 32 of less diameter than housing attachment opening 37, and also depicted in FIG. 9, wherein connector 5 inserted into opening 37 when components 13 and 23 of FIG. 5 are assembled at manufacture, allows adaptor housing 7 axial rotation adjustments, left to right or right to left, as needed, and at the same time horizontal traversing of flexible conduit up to 180 degrees, left to right or right to left, as needed when relocating access point of receiver housing 1.

FIG. 9 depicts bottom exploded view of receiver housing 1 comprising; rear and front components 10 and 19, respectfully, as in FIG. 5 and receiver housing 1 depicting conduit connector attachment, inward facing centered half circle opening 33 and 38, respectfully, forming the circular conduit connector attachment opening when components 10 and 19 are assembled during manufacture.

FIG. 10 depicts bottom exploded view adaptor housing 7 comprising; components 13 and 23, respectfully as in FIG. 6, and adaptor housing 7 depicting conduit connector attachment, inward facing centered half circle opening 37 and 39 respectfully, forming the circular conduit connector attachment opening when said components 13 and 23 are assembled during manufacture.

Figure 11:
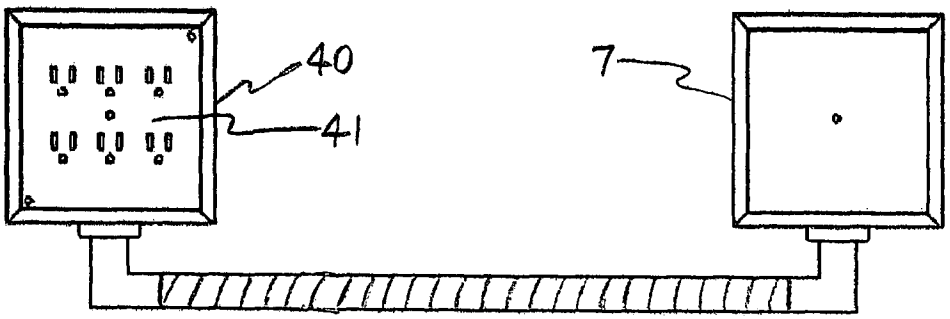
FIG. 11 depicts a front plan view of device showing a multiple plug outlet as a receiver housing option.

FIG. 11 depicts device showing an optional receiver housing 40 as a six plugin access style receptacle 41. Adaptor housing 7 is the same as previous drawings shown and specifications stated thereby showing versatility and variety of the devices receiver housing design.

Figure 12:
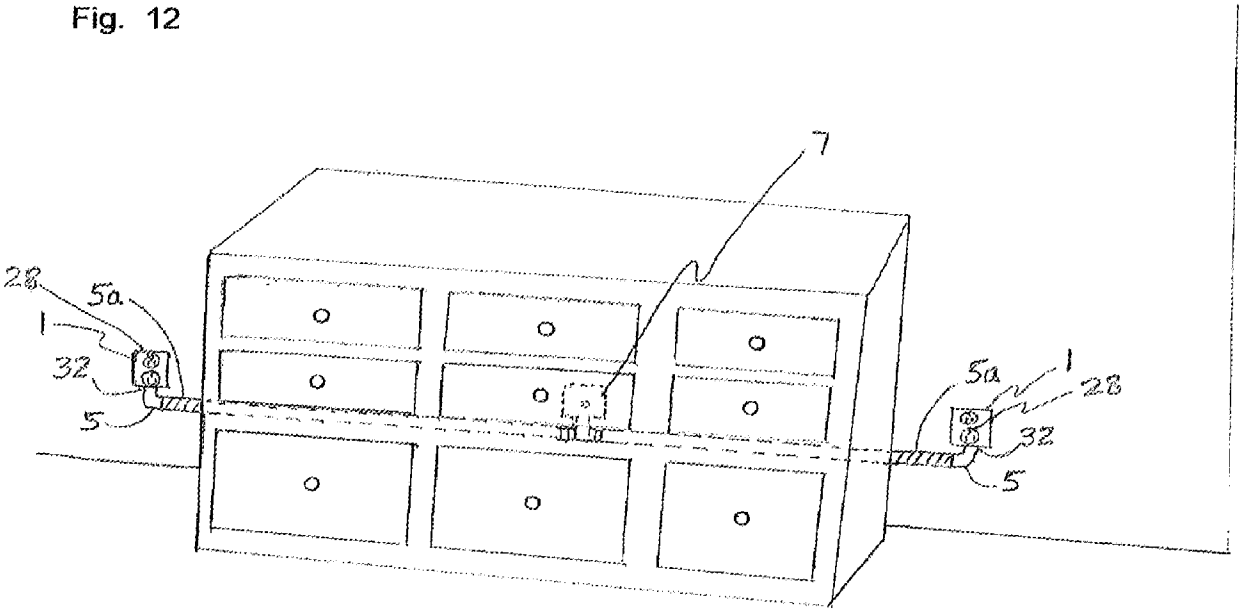
FIG. 12 depicts device relocating receiver housing horizontally, left or right only, of existing receptacle behind dresser and not showing vertical adjustments.

FIG. 12 depicts as one example of device utilization wherein adaptor housing 7, depicted in FIG.'S 2, 4, 6, 8, 10, and 11, is adapted to an existing common duplex receptacle hidden behind a common chest of drawers, connected to a receiver housing 1 providing an alternative relocated common duplex receptacle 28 depicted in FIG.'S 1 and 7 to the right of said receptacle, and also depicting the devices ability of both housings rotational abilities, and by the conduit connection method 32 allowing conduit and adaptor housing traverse or swing back across receiver housing allowing adaptor housing to also be relocated to the left of said existing hidden receptacle as desired or required by individuals thereby to a point adjacent of receiver 7 for better and safer receptacle access.

The drawings of this application depicts only one duplex electrical receptacle style utilized for application purposes therefore the scope of what can be accomplished by the device of this application is not limited to this disclosure only, or by the housings adaptive capabilities, various forms of conduit and conduit connectors, or wire types utilized, can easily be accomplished and would be readily apparent to one skilled in the art as within the scope of the invention's abilities. The depiction in FIG. 12 only shows one method of relocation, not showing vertical adjustment abilities, or the inversion capabilities of the receiver housing to correcting a ground pin down orientation to a ground pin up orientation or the reverse, therefore not depicting the full range of relocation adjustment abilities of the invention disclosed.

Furthermore, it is not the intent of the inventors of the device of this application to imply any patentability of common electrical receptacles, conduits utilized, or wire types, that are commonly available as "off-the-shelf" items, but are utilized as part of the device, to enhance device abilities. The electrical receptacle adaptive potential of the receiver housing, wiring, conduits, and conduit connector groove as housing attachment point, illustrated and disclosed herein, allows many areas of adaptability of common receptacles conduits, and wiring in residential and commercial applications, including specialty markets such as hospitals or manufacturing when dealing with sensitive equipment and devices where wall construction for adding or changing electrical wall boxes, to move or relocate receptacles and other electrical items, could or would present problems or situations of increased risk but avoided because of devices quick adaptability and simple basic utility. Additionally, the specification herein stating hardware items for attaching receiver housing and securing flexible conduit between device housings to walls, ceilings, or partitions would be included, such as wall mounting plastic anchors with corresponding hardware, and or attachable and removable glue strips, all commonly available and proven over many years to be secure and durable methods by industry standards and codes set forth.

What is claimed is:

1. An electrical outlet receptacle relocation device comprising:

a separate adaptor housing for securing to an existing duplex electrical receptacle, comprising:

a front molded rectangular component having a plane front surface with no electrical plugin access, wherein the plane front surface having at least one centered hardware thru-hole as attachment means to the existing duplex electrical receptacle;

a rear molded rectangular component having at least one neutral pin, at least one hot pin and at least one ground pin extending from a rear side thereof for electrically connecting to the existing electrical receptacle;

wherein the front molded rectangular component and the rear molded rectangular component when assembled together forming a first centered circular conduit connector attachment opening on a bottom side thereof;

a first conduit connector having a first end and a second end, the first end of the first conduit connector inserted into the first centered circular conduit connector attachment opening along a first vertical axis thereof allowing the separate adaptor housing to rotate left or right about the first vertical axis;

a flexible conduit having a first end and a second end, the first end of the flexible conduit connected to the second end of the conduit connector;

a separate receiver housing comprising:

a front molded rectangular member having a standard duplex electrical receptacle faceplate, wherein the standard duplex electrical receptacle faceplate having at least one opening and at least one centered thru-hole for receiving a faceplate retainer screw;

a rear molded rectangular member having a plurality of hardware attachments holes for attaching the separate receiver housing to a wall or a surface, wherein the rear molded rectangular member having at least one standard duplex electrical receptacle extending into the at least one opening of the standard duplex electrical receptacle faceplate;

wherein the front molded rectangular member and the rear molded rectangular member of the separate receiver housing when assembled together forming a second centered circular conduit connector attachment opening on a bottom side thereof;

a second conduit connector having a first end and a second end, the first end of the second conduit connector inserted into the second centered circular conduit connector attachment opening along a second vertical axis thereof allowing the separate receiver housing to rotate left or right about the second vertical axis;

wherein the second end of the flexible conduit connected to the second end of the second conduit connector;

a plurality of electrical wiring for transferring electrical power from the separate adaptor housing to the separate receiver housing are channeling inside the first conduit connector, the flexible conduit and the second conduit connector;

wherein when the separate receiver housing connected to the separate adaptor housing via the first conduit connector, the flexible conduit and the second conduit connector, the separate receiver housing providing at least one alternative location for the existing duplex electrical receptacle.

2. The electrical outlet receptacle relocation device according to claim 1, wherein the separate receiver housing having multiple internal molded supports and multiple internal hardware attachment points which accepts at least one common duplex electrical receptacle attached within the separate receiver housing, wherein the separate receiver housing having multiple adjustment options, traversing horizontally left or right, vertically above or below, and any combinations of traversing, wherein the separate receiver housing having an axis rotation up to 180 degrees, wherein the separate receiver housing allows individuals to maintain correct and level of the existing duplex electrical receptacle orientation at all times regardless of the placement of the separate receiver housing from the separate adaptor housing when selecting a point of the at least one standard duplex electrical receptacle relocation before securing the separate receiver housing to walls or ceiling surfaces.

3. The electrical outlet receptacle relocation device according to claim 1, wherein the separate receiver housing having multiple internal molded supports and multiple internal hardware attachment points accepts up to two common duplex electrical receptacles of the same receptacle style, or can be different styles as may be required, attached within the same separate receiver housing and provides multiple adjustment options, horizontally left or right, vertically above or below, and any combinations of traversing, wherein the separate receiver housing having an axis rotation up to 180 degrees, the separate receiver housing allows individuals to maintain correct and level of the existing duplex electrical receptacle orientation at all times regardless of the placement of the separate receiver housing from the separate adaptor housing when selecting a point of the at least one standard duplex electrical receptacle relocation before securing the separate receiver housing to walls or ceiling surfaces.

4. The electrical outlet receptacle relocation device according to claim 1, wherein the separate receiver housing having multiple internal molded supports and multiple internal hardware attachment points accepts at least one common single electrical receptacles attached within the separate receiver housing and provides multiple adjustment options, horizontally left or right, vertically above or below, and any combinations of traversing, wherein the separate receiver housing having an axis rotation up to 180 degrees, the separate receiver housing allows individuals to maintain correct and level of the existing duplex electrical receptacle orientation at all times regardless of the placement of the separate receiver housing from the separate adaptor housing when selecting a point of the at least one standard duplex electrical receptacle relocation before securing the separate receiver housing to walls or ceiling surfaces.

5. The electrical outlet receptacle relocation device according to claim 1, wherein the separate receiver housing having multiple internal molded supports and multiple internal hardware attachment points accepts up to two single electrical receptacles, same type or different types, attached within the separate receiver housing and provides multiple adjustment options, horizontally left or right, vertically above or below, and any combinations of traversing, wherein the separate receiver housing having an axis rotation up to 180 degrees, the separate receiver housing allows individuals to maintain correct and level of the existing duplex electrical receptacle orientation at all times regardless of the placement of the separate receiver housing from the separate adaptor housing when selecting a point of the at least one standard duplex electrical receptacle relocation before securing the separate receiver housing to walls or ceiling surfaces.

6. The electrical outlet receptacle relocation device according to claim 1, wherein each of the separate adaptor housing and the separate receiver housing capable of rotating about their respective vertical axis up to 180 degrees, wherein the separate receiver housing having alignment abilities thereby allows novice individuals the ability to change the orientation of the existing duplex electrical receptacle from ground in down to ground pin up or ground pin up to ground pin down by inverting the separate receiver housing before securing the separate receiver housing to walls or ceiling surfaces.

7. The electrical outlet receptacle relocation device according to claim 1, wherein the separate receiver housing having a multiple plugin access option of up to six plugins, multiple adjustment options including traversing horizontally left or right, vertically above or below, and any combinations of traversing and axis rotation up to 180 degrees for allowing individuals to maintain correct and level receptacle orientation at all times regardless of the placement of the separate receiver housing from the separate adaptor housing, wherein the separate receiver housing can also be inverted in order to change the ground in orientation of the existing duplex electrical receptacle if required by federal, state, and local building codes or for other reasons before securing the separate receiver housing to walls or ceiling surfaces.

8. The electrical outlet receptacle relocation device according to claim 1, wherein the electrical outlet receptacle relocation device is self-contained, fully assembled, and readily adaptable and comprising disclosed components and manner of their assembly which by nature of the conduit connectors attachment points at each housing and further utilizing flexible electrical conduit and housings that rotate up to 180 degrees at each axis provides individuals, relocating hidden or difficult access receptacles, many variations of horizontal and vertical adjustments of the receiver from the adaptor, wherein the separate receiver housing accepting either one or up to two common standard single or duplex electrical receptacles secured within and wherein the separate receiver housing can also be inverted in order to change the ground pin orientation of the existing duplex electrical receptacle if required by federal, state, and local building codes or for other reasons before securing the separate receiver housing to walls or ceiling surfaces.

* * * * *